United States Patent [19]

Brown

[11] 4,339,885

[45] Jul. 20, 1982

[54] IDENTIFICATION MEANS FOR ROLLED-UP ARTICLES, SUCH AS DRAWINGS AND THE LIKE

[76] Inventor: Richard K. Brown, 8116 Kenova La., Springfield, Va. 22153

[21] Appl. No.: 210,406

[22] Filed: Nov. 25, 1980

[51] Int. Cl.[3] ..... G09F 3/00; G09F 3/18; B05C 17/00; B65D 69/00

[52] U.S. Cl. ..... 40/309; 40/19; 206/225; 206/1.7; 206/804; 229/4.5

[58] Field of Search ..... 40/309, 10 R, 19; 229/93, 4.5; 206/225, 226, 1.7, 306, 315 R, 53, 407, 446, 804, 308, 575, 224; 138/96 R, 118, 137; 215/216, 224, 200, 317, 318, 319, 323, 337; 224/45 M

[56] References Cited

U.S. PATENT DOCUMENTS

| | | | |
|---|---|---|---|
| 423,712 | 3/1890 | Arnold | 206/407 |
| 945,417 | 1/1910 | Price | 206/225 |
| 1,172,117 | 2/1916 | Dickinson | 206/306 |
| 2,157,750 | 5/1939 | Dunn | 40/20 R |
| 2,576,725 | 11/1951 | Schoelles | 206/446 |
| 2,962,187 | 11/1960 | Morris | 206/407 |
| 2,982,458 | 5/1961 | Hennion | 229/4.5 |
| 3,318,334 | 5/1967 | Fuzzell | 229/4.5 |
| 3,500,280 | 3/1970 | Ensign | 206/306 |
| 3,532,130 | 10/1970 | Dunlap | 40/309 |
| 3,718,999 | 3/1973 | Voyce | 40/309 |

FOREIGN PATENT DOCUMENTS 3434 of 1883 United Kingdom ..... 40/309

*Primary Examiner*—Robert Peshock
*Assistant Examiner*—Michael J. Foycik
*Attorney, Agent, or Firm*—Birch, Stewart, Kolasch & Birch

[57] ABSTRACT

A generally tubular-shaped article which is adapted to be placed around the end of a rolled-up article, such as rolled-up drawings and the like, for identification purposes. The tubular-shaped article has a cylindrical tube having at one end and attached thereto another cylindrically-shaped object of a rubber-like composition. The rubber-like cylindrically-shaped object is adhered to the outer periphery of the one end of the cylindrical tube. A cap is placed around the outer periphery of the opposite end of the cylindrical object. The cap has a label attached for identifying the rolled-up article, such as the rolled-up drawings placed therein. The cylindrical object is flexible, thereby permitting the user to grip the drawings using the rubber-like cylindrical object. Other embodiments include a concave-shaped cylindrical object for gripping the drawing when placed therein. In addition, a pebble grain may be deposited on the apex portion of the inner periphery of the concave-shaped cylindrical object for providing increased frictional contact between the concave rubber-like cylindrical object and the rolled-up drawings placed therein.

7 Claims, 5 Drawing Figures

IDENTIFICATION MEANS FOR ROLLED-UP ARTICLES, SUCH AS DRAWINGS AND THE LIKE

BACKGROUND OF THE INVENTION

1. Field of the Invention

The present invention generally relates to an identification means for rolled-up articles, such as rolled-up drawings and the like, and a means for gripping the rolled-up articles placed therein.

2. Description of the Prior Art

In the prior art, various methods have been used to identify rolled-up drawings or rolled-up articles. One of the methods included the utilization of a disc and a metal band attached to each other by longitudinal rubberbands. The metal band was fitted over the rolled-up article and guided along, longitudinally, the rolled-up article until the disc came into contact with one end of the rolled-up article. It was necessary to use two hands to perform this function since the rubberbands had a tendency to bend.

In addition to the above-mentioned prior art structure, additional types of structures of this type in the prior art consisted of cylindrical tube having one end closed and the other end open. The closed end would have a label thereon for labeling the contents therein. However, this cylindrical tube did not possess a gripping means for gripping the rolled-up article from a point externally the tube. When the rolled articles were placed in a stack, the cylindrical tube would have a tendency to slip off one end of the rolled article when pulling a selected one of the rolled articles from the stack.

SUMMARY OF THE INVENTION

It is a primary object of the present invention to provide an identification means for rolled-up articles which possesses a means for gripping the rolled article from an external portion thereof thereby facilitating the ease by which the rolled article, having the identification means attached to one end thereof, may be pulled from a stack of other rolled articles.

Another object of the present invention is to provide an identification means having a rubber portion placed near an opposite end of a cylindrical tube, interposed between the cylindrical tube and an identification cap for enabling the user to grip the rolled article from an external portion thereof.

A further object of the present invention is to provide an identification means having the rubber portion attached near an opposite end thereof, the rubber portion being concave in shape thereby gripping the rolled article from an internal portion of the identification means when the rolled up article is inserted therein.

A still further object of the present invention is to provide a rubber portion having a concave shape, the rubber portion varying in thickness from the two ends thereof, terminating at a central point, the thicker portion being at the two ends thereof, the thinner portion being at the central point, thereby ensuring that the rubber portion will maintain its concave shape.

A still further object of the present invention is to provide an identification means having a concave rubber portion, the apex position of the concave rubber portion having a coating of a pebble grain material disposed over an internal surface area thereof for ensuring a tight grip between the concave rubber portion and the rolled-up article placed therein thereby facilitating the ease by which the rolled article may be gripped from an external point of the concave rubber portion of identification means of the present invention.

These and other objects of the present invention are accomplished by providing an identification means for rolled articles comprising a cylindrical tube adapted to receive one end of the rolled-up article. At an opposite end of the cylindrical tube, a cylindrical object made of a rubber-like material is adhered to the outer periphery thereof. At the opposite end of the cylindrical object, an identification cap is placed around the outer periphery thereof. The rubber-like cylindrical object is flexible thereby permitting the user to grip the rolled-up article from an external portion thereof, by gripping the identification means around the rubber-like cylindrical object, thereby flexing the rubber-like cylindrical object until it comes into contact with the rolled-up article placed therein. The rubber-like cylindrical object has a plurality of tip portions, also made of a rubber-like composition integrally placed around the inner periphery of the cylindrical object for assisting in the gripping of the rolled-up articles placed therein.

The cylindrical tube has a diameter which is less than the diameter of the rubber-like cylindrical object, the rubber-like cylindrical object having a diameter which is less than the diameter of the identification cap. This enables the user to place the rolled-up article within the identification means of the present invention while preventing the ends of the rolled-up article from engaging with the end portions of the cylindrical object and the identification cap.

In addition, a portion of the rubber-like cylindrical object may be concave in shape, having an apex position facing internally of the cylindrical tube. This causes the rolled-up article to engage with the apex portion of the concave rubber-like cylindrical object when the rolled-up article is placed therein. This facilitates the ease by which the user may grip the rolled-up article from periphery of the rubber-like cylindrical object.

The concave rubber-like cylindrical object may have a thickness which varies from the two opposite ends thereof, terminating at a central point. The thickness may be greatest at the two opposite ends thereof, and the thickness of the rubber-like cylindrical object should be least at the central point in order to maintain the concave shape of the rubber-like cylindrical object.

A label is attached to the identification cap for identifying the rolled-up article placed within the cylindrical tube of the present invention.

In lieu of the tip portions mentioned above, the internal portion of the rubber-like cylindrical object may have a coating of a pebble grain material disposed thereon. This coating may consist of packed sand adhesively secured to the internal periphery of the rubber-like cylindrical object. This pebble grain coating, being very rough in character, will engage with the surface of the rolled-up article when the article is placed within the cylindrical tube of the identification means of the present invention. Since the coating is adapted to engage with the external surface of the rolled-up article, a firm friction grip is maintained between the coating and the external surface of the rolled-up article when the rubber-like cylindrical object is gripped from an external portion thereof. This facilitates the ease by which the rolled-up article may be pulled out from a stack of other articles, without causing the identification means of the present invention from slipping off one end thereof.

If the diameter of the cylindrical tube is slightly less than the diameter of the identification cap, the outer diameters at both ends of the concave rubber-like cylindrical object will be approximately equal. The outer surface of the rolled-up article engages with the internal apex portion of the concave rubber-like cylindrical object. However, only a relatively moderate amount of pressure is exerted by the apex portion of the concave rubber-like cylindrical object on the external surface of the rolled-up article placed therein.

On the other hand, if the diameter of the cylindrical tube is approximately equal to the diameter of the identification cap, the outer diameters at both ends of the concave rubber-like cylindrical object will vary. Thus, a greater degree of force is exerted by the apex portion of the concave rubber-like cylindrical object on the outer peripheral surface of the rolled-up article placed therein. This increases the frictional contact between the apex portion and the outer peripheral surface. Therefore, the rolled-up article will more easily be pulled from a stack of other articles when the user grips the rolled-up article using the rubber-like cylindrical object as a gripping means.

Further scope of applicability of the present invention will become apparent from the detailed description given hereinafter. However, it should be understood that the detailed description and specific example, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
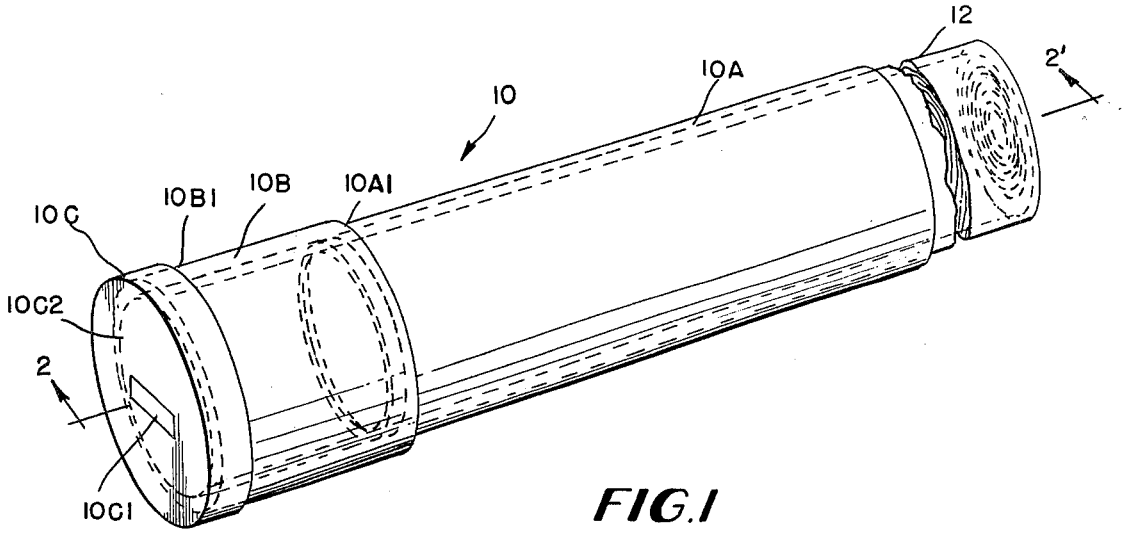
FIG. 1 is a three-dimensional view of a first embodiment of the identification means of the present invention illustrating a cylindrical tube, and an identification cap placed around an opposite peripheral end of the rubber-like cylindrical object, and having a label attached thereto for identifying the rolled-up article placed therein.
Figure 2:
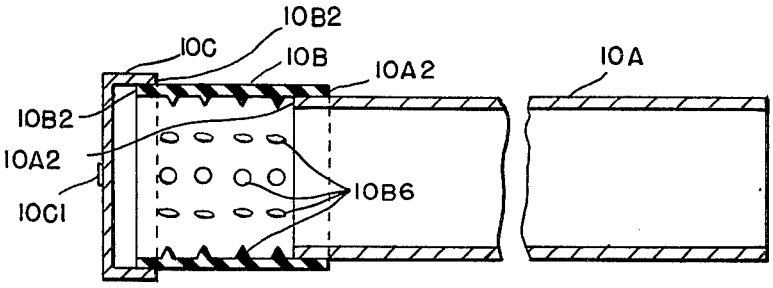
FIG. 2 represents the embodiment of invention shown in FIG. 1 taken along section line 2—2' shown in FIG. 1.

Referring to FIGS. 1 and 2, the identification means of the present invention 10 is shown. It consists of a first body 10A adapted to receive one end of rolled-up articles, such as drawings and the like. The first body 10A should preferably be cylindrical in shape although the first body may also be in the form of other shapes as well for use with the present invention. At one end 10A1 of the first body 10A, a second body 10B is secured to the external periphery of the one end 10A1 of the first body 10A. The second body 10B is secured to the first body 10A at the one end 10A1 thereon by various means, such as an adhesive material placed between the internal surface of the second body 10B and the outer peripheral surface of the first body 10A. The second body 10B should take the shape of the first body 10A. A plurality of tip portions 10B6 are placed internally if the second body 10B, around the periphery thereof. The Tip portions 10B6 are pointed in shape, and point toward the longitudinal axis of the identification means 10. The Tip portions 10B6 are formed integrally with the second body 10B and assist in gripping the rolled-up articles placed therein when the second body 10B is gripped from an external portion thereof.

An identification cap 10C is secured to the outer peripheral surface of one end 10B1 of the second body 10B. The identification cap should also take the shape of the first and second bodies, respectively.

A label 10C1 is preferably placed at the end surface 10C2 of the identification cap 10C. The label 10C1 identifies the contents of the rolled-up article 12 placed within the identification means 10 of the present invention. Note, however that the label 10C1 may be placed anywhere on the external surface of the identification means 10.

Referring to FIG. 2, a section of FIG. 1 is shown, taken along section lines 2—2' of FIG. 1. The diameter of the first body 10A is less than the diameter of the second body 10B, the diameter of the second body 10B being less than the diameter of the identification cap 10C. This is necessary in order to allow the rolled-up article 12 to be placed within the identification means 10 of the present invention without engaging with the opposite ends 10A2, or 10B2 of the second body 10B, or the identification cap 10C, respectively.

The second body 10B is make of the resilient material, such as rubber, having a high coefficient of friction when placed in contact with a solid surface. The first body 10A and the identification cap 10C may be made of any solid material, such as a rigid paper product, rigid cardboard, or a metallic material.

Figure 3:
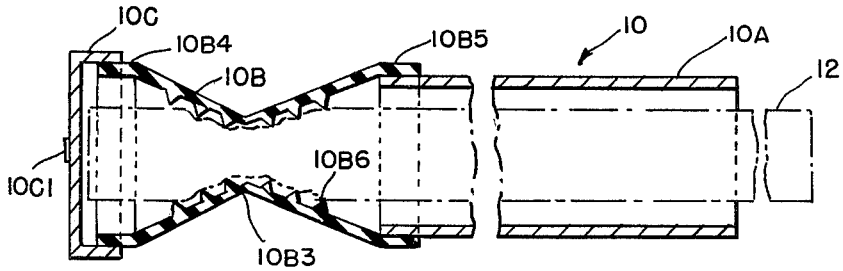
FIG. 3 represents the embodiment of invention shown in FIG. 1, taken along section 2—2' of FIG. 1, but having a concave shaped rubber-like cylindrical object disposed between the identification cap and the cylindrical tube, and having a thickness at both ends thereof which is greater than the thickness of the rubber-like cylindrical object at a central point thereof.

Referring to FIG. 3, the identification means 10 of the present invention is shown, taken in section along lines 2—2' of FIG. 1. However, in this embodiment the second body 10B is concave is shape, and points internally of the first body 10A for engaging with the outer peripheral surface of the rolled-up articles 12 when the articles 12 are placed therein. Note the manner by which the central point 10B3 of the second body 10B, representing the apex position of the concave second body 10B, engages with the outer peripheral surface 12A of the rolled-up drawings 12 placed therein. Since the rolled-up article is very flexible, it will tend to bend at the portion engaged by the central point 10B3 of the second body 10B. The concave shape of the second body 10B in conjunction with the gripping actions of the pointed Tip portions 10B6 a friction grip by which the rolled-up article 12 will tend to maintain its position within the identification means 10 of the present invention. When the rolled-up articles 12 are placed in a stack, the central point 10B3 and the Tip portions 10B6 will bend the article 12 at a plurality of points and still prevent the identification means 10 of the present invention from slipping off the end of the rolled-up article 12.

Also, in referring to the present invention shown in FIG. 3, note that the outer diameter of the first body 10A is less than the outer diameter of the identification cap 10C. Also note that the diameter of one end 10B4 of the second body 10B is approximately equal to the diameter of the other end 10B5 of the second body 10B. Due to this configuration, an unnecessary degree of pressure will not be exerted by the central point 10B3 of the concave second body 10B on an external surface of article 12. Therefore, it will be easier to slip the identification means 10 of the present invention off the end of the rolled-up article 12 when removal is required. However, if a greater degree of pressure is required to be exerted by the central point 10B3 on the outer peripheral surface 12A of rolled-up articles 12, the diametrical configuration of the first body, the second body and the identification cap, shown in FIG. 4, will allow provision of this degree of additional pressure.

Figure 4:
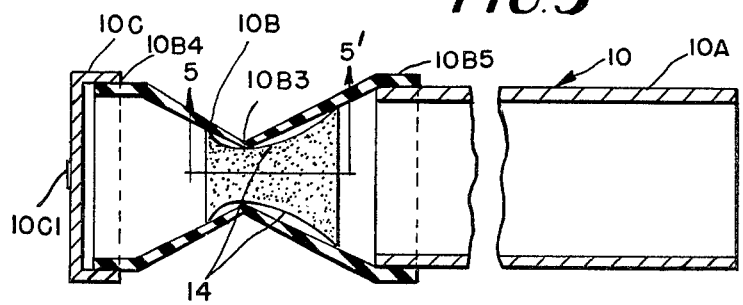
FIG. 4 represents another embodiment of the present invention, illustrating a section of the embodiment of FIG. 1 taken along 2—2' of FIG. 1, possessing the concave shape of the rubber-like cylindrical object, and having a coating of a pebble grain material adhesively disposed in the form of a ring around an internal surface of the rubber-like cylindrical object at a central portion thereof.

Referring to FIG. 4, the identification means 10 of the present invention is again shown in sections, taken along lines 2—2' of FIG. 1, except for the fact that the identification means 10 shown in FIG. 4 has a first body 10A having a diameter which is approximately equal to the diameter of the identification cap 10C. Therefore, the outer diameter of one end 10B4 of the second body 10B will be slightly less than the outer diameter of the other end 10B5 of the second body 10B. In this manner, the additional pressure will be exerted by the central point 10B3 on the outer peripheral surface of the rolled-up article 12 when placed therein.

An identification cap 10C is secured to an outer peripheral surface of second body 10B. A label 10C1 may be secured to the identification cap 10C for identifying the rolled-up articles placed therein. Referring again to FIG. 4, a coating of pebble grain material 14 is shown disposed around the internal portion of the second body 10B, formed centrally of the second body 10B, in the form of a ring encompassing the central point 10B3. The pebble grain coating 14 may be used in lieu of Tip portions 10B6. The coating 14 coats the internal surface of the second body 10B in the vicinity of the central point 10B3. The pebble grain coating will increase the coefficient of friction of the second body 10B when in contact with the external surface of the rolled-up article 12 thereby ensuring that the identification means 10 of the present invention will not slip off one end of the rolled-up drawings 12 placed therein. It also ensures that the user will more easily be able to grip the external portion of the drawing, via second body 10B, when the rolled-up drawing 12 is pulled away from a stack of other drawings. The pebble grain coating 14 is comprised of packed sand material disposed within an adhesive coating, coating the internal portion of the second body 10B.

Figure 5:
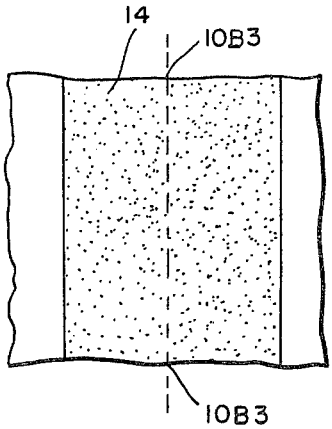
FIG. 5 represents a view of the rubber-like cylindrical object as shown in FIG. 4, taken along the section line 5—5' of FIG. 4, illustrating the pebble grain coating disposed over the internal surface of the cylindrical object.

Referring to FIG. 5, a section of FIG. 4 along lines 5—5' of FIG. 4 is shown. The pebble grain coating 14 is shown in the form of a ring coating the inside surface of the second body 10B. Note the position of the central point 10B3 of the second body 10B shown in FIG. 5. The pebble grain coating 14 increases the coefficient of friction when in contact with the outer peripheral surface 12B of the rolled-up article 12 when the article is placed therein.

In operation, the identification means of the present invention provides a means for identifying the rolled-up article placed therein, and also provides a means for gripping the rolled-up article 12 externally thereof by gripping the identification means 10 around the outer peripheral surface of the second body 10B. Since the second body 10B is a resilient material, having a high coefficient of friction when in contact with a solid surface, the second body will flex until it comes into contact with the outer peripheral surface 12A of the rolled-up article 12. Once the second body 10B comes into contact with the outer peripheral surface of the rolled-up article 12, the tip portions 10B6 will provide a firm frictional contact between article 12 and the second body 10B. This, in turn, will permit the user to pull the rolled-up article 12 out from a stack of other articles, the identification means 10 will not slip off the end of the rolled-up articles 12 while the article 12 is being pulled out from the stack. The diameter of the first body 10A is made less than the diameter of the second body 10B, the diameter of the second body 10B being less than the diameter of the identification cap 10C in order to permit the rolled-up article 12 to be inserted within the identification means 10 of the present invention without butting against the side surfaces 10A2 and 10B2 of the second body 10B and the identification cap 10C, respectively.

In order to firmly hold the identification means 10 of the present invention onto the end of the rolled-up article 12, the second body 10B is formed into a concave configuration, wherein the second body 10B points internally of the first body 10A. In this way, the central point 10B3 of the second body 10B will contact and bend the outer peripheral surface 12A of the rolled-up article 12, causing a protrusion therein. This holds the identification means 10 of the present invention firmly onto the end of the rolled-up article 12.

The second body 10B varies in thickness from the two ends 10B4 and 10B5 toward the central point 10B3. The thickness of the second body 10B at the two outer points 10B4 and 10B5 may be greater than the thickness of the second body 10B at the central point 10B3. This maintains the second body 10B in its concave configuration, dispite the existence of internal outward pressures exerted thereon.

In order to lessen somewhat the amount of pressure exerted by the central point 10B3 around the outer peripheral surface 12A of the rolled-up article 12, the diameter of the first body 10A is made less than the diameter of the identification cap 10C. The two outer end diameters of the second body 10B, at the first end 10B4 and the second end 10B5, are approximately equal to one another in this embodiment. Consequently, the central point 10B3 will exert a pressure around the outer peripheral portion 12A of the rolled-up article 12, however, this pressure will not be as great as the pressure exerted by the central point 10B3 in the embodiment of invention shown in FIG. 4. In this embodiment, the outer diameter of the first body 10A and the identification cap 10C are approximately equal. The diameter of the one end 10B4 of the second body 10B is less than the diameter of the other end 10B5 of the second body 10B. Consequently, when the rolled-up article 12 is placed within the identification means 10 of the present invention, a greater degree of force is exerted by the central point 10B3 around the outer peripheral surface 12A of the rolled-up article 12.

In order to further increase the coefficient of friction exerted by the second body 10B, around the outer peripheral surface 12A of article 12. The Tip portions 10B6 may be used, or, a pebble grain coating may be deposited on the internal surface of the second body 10B such that the coating will straddle the central point 10B3. This pebble grain coating is made of a packed sandtype material disposed in an adhesive coating. Therefore, when the rolled-up article 12 comes into contact with the pebble grain coating 14, a greater degree of friction will be exerted by the second body 10B in this embodiment than will be exerted by the second body in the other alternative embodiments of invention present in this application. In addition, when the user grips the second body 10B around the outer peripheral portion thereof, the coating 14 will more firmly grip the outer peripheral surface 12A of the rolled-up article 12 thereby more easily extracting the rolled-up article 12 from a stack of other articles.

Consequently, with the present invention, the identification means 10 of the present invention may be slipped onto one end of the rolled-up article 12, and maintained at this position due to the configuration of the second body 10B. Since the second body 10B with the Tip portions 10B6 provide a high coefficient of friction when placed against a solid surface, the second body 10B provides a gripping means for gripping the identification means 10 around the rolled-up drawing 12, and further providing the necessary frictional contact therebetween to remove the rolled-up article 12 from a stack of other articles.

The invention being thus described, it will be obvious that the same may be varied in many ways. Such variations are not to be regarded as a departure from the spirit and scope of the invention, and all such modifications as would be obvious to one skilled in art are intended to be included within the scope of the following claims.

What is claimed is:

1. An identification means for enclosing at least a portion of rolled-up articles and for identifying said articles, comprising:

first body means having one end thereof for receiving the rolled-up article, the first body means being made of a rigid material:

second body means having one end thereof attached to the opposite end of said first body means, said second body means being made of a resilient material for gripping the rolled-up article placed therein, and being made in the form of a single unitary structure, said second body means being concave in shape and including a central apex point and two opposite ends, the central apex point pointing internally of said first body means, the thickness of the two opposite ends of the second body means being greater than the thickness of said second body means at said central apex point;

cover means for enclosing the opposite end of said second body means; and label means disposed on said cover means for identifying the rolled-up article placed therein.

2. An identification means in accordance with claim 1, wherein the resilient concave second body means further comprises a plurality of resilient pointed Tip ends integrally placed around an internal surface thereof for increasing the frictional grip between the article and the second body means when the second body means is gripped from an external portion thereof.

3. An identification means in accordance with claim 1 further comprising:

pebble grain adhesive coating deposited on the internal surface of said second body means for increasing the coefficient of friction of said second body means when said second body means is pressed into contact with an outer peripheral surface of said rolled-up article placed therein.

4. An identification means in accordance with claim 1, wherein the one end of said second body means is secured to an external surface of the opposite end of said first body means, the opposite end of said second means being secured to an internal surface of said cover means.

5. An identification means in accordance with claim 4, wherein the first and second body means and said cover means are cylindrical in shape, the diameter of the first body means being less than the diameter of the cover means.

6. An identification means in accordance with claim 4, wherein said first and second body means and said cover means are cylindrical in shape, the diameter of the first body means being approximately equal to the diameter of the cover means.

7. An identification means in accordance with claims 5 or 6, wherein said second body means comprises a rubber-like composition.

* * * * *